United States Patent [19]

Wallermann

[11] Patent Number: 4,711,412

[45] Date of Patent: Dec. 8, 1987

[54] METHOD FOR HOMING ONTO A TARGET

[75] Inventor: Heinrich Wallermann, Lauf, Fed. Rep. of Germany

[73] Assignee: Diehl GmbH & Co., Nuremberg, Fed. Rep. of Germany

[21] Appl. No.: 850,716

[22] Filed: Apr. 9, 1986

[30] Foreign Application Priority Data

Jul. 12, 1985 [DE] Fed. Rep. of Germany ..... 3524925

[51] Int. Cl.[4] ..... F41G 7/00

[52] U.S. Cl. ..... 244/3.15; 244/3.21

[58] Field of Search ..... 244/3.15, 3.21, 181, 244/184, 185

[56] References Cited

U.S. PATENT DOCUMENTS

| | | | |
|---|---|---|---|
| 2,821,349 | 1/1958 | Sohn | 244/3.15 |
| 2,824,710 | 2/1958 | Hall | 24/3.21 |
| 3,695,555 | 10/1972 | Chadwick | 244/3.14 |
| 3,946,968 | 3/1976 | Stallard | 244/3.21 |
| 4,530,476 | 7/1985 | Thurber, Jr. et al. | 24/3.21 |
| 4,590,567 | 5/1986 | Hofmann et al. | 244/3.21 |
| 4,606,514 | 8/1986 | Sundermeyer | 244/3.15 |

FOREIGN PATENT DOCUMENTS

| | | |
|---|---|---|
| 3119185 | 5/1984 | Fed. Rep. of Germany . |
| 1605007 | 12/1981 | United Kingdom . |
| 2134632 | 8/1984 | United Kingdom . |

OTHER PUBLICATIONS

*Defense Electronics,* Jun. 1984, p. 102.

*Primary Examiner*—Charles T. Jordan
*Attorney, Agent, or Firm*—Scully, Scott, Murphy & Presser

[57] ABSTRACT

A method for homing onto a target detected forwardly laterally or sideways offset from the glide trajectory of a projectile which is equipped with a search head, with control surfaces and with horizontal glide surfaces, through the implementation of roll motion for the yaw maneuver.

4 Claims, 3 Drawing Figures

METHOD FOR HOMING ONTO A TARGET

BACKGROUND OF THE INVENTION

1. Field of the Invention

The present invention relates to a method for homing onto a target which is detected forwardly sideways offset from the glide trajectory of a projectile which is equipped with a search head, with control surfaces and with horizontal glide surfaces, through the implementation of a roll motion for the yaw maneuver.

2. Discussion of the Prior Art

A method of that type has been known from the disclosure of U.S. Pat. No. 3,695,555, which is directed to an artillery projectile or missile which is guidable during its final flight phase; or from the disclosure of British Pat. No. 1,605,007 for a projectile in the configuration of a target-tracking torpedo. However, the invention especially relates to projectiles which are guidable during their final flight phase, as is known from the disclosure in DEFENSE ELECTRONICS, Volume of June 1984, page 102, as an article of subordinate ammunition or submissile.

The simplest conditions for the maneuverability of such a projectile, considered from the standpoint of guidance technology, are obtained when a crossed pair of tail guidances or control surfaces has associated therewith a similarly crossed pair of substantially larger gliding wings or surfaces which are arranged opposite the control surfaces. Inasmuch as the firing or the start of the projectile cannot be implemented with extended control or guidance surfaces and gliding surfaces because of constructive reasons, while on the other hand, a limitation in the caliber for the design of the projectile and the spatial requirement for the warhead and target-tracking control installations, do not render available the space which is necessary for the retraction of large gliding wings, whereas the desirably large aerodynamic gliding flight ability cannot be attained with only small gliding wings or surfaces, in projectiles pursuant to the present invention, one must be satisfied with horizontal gliding wings of preferably the type under consideration.

As is explained in detail hereinbelow in conjunction with FIG. 1 of the drawings, in view of the lack of vertically oriented gliding wings or surfaces, the maneuverability in the yaw direction (in essence, in a sideways or lateral displacement of the longitudinal axis of the projectile) out of an actually given flight position, is considerably restricted. For homing onto a sideways or laterally offset target, this resultingly necessitates a displacement of the lift vector from the vertical into a direction towards the forwardly sideways offset target, which requires a correspondingly intense roll movement of the projectile about its longitudinal axis. However, inasmuch as such a projectile does not represent a body which is symmetrical with regard to its aerodynamic flow properties, every change in the roll position produces reactions over other aerodynamic influences, and thereby undesirable reactions on the flying behavior. These reactions are not linear in nature, and are particularly intense at large roll angles; which requires excessively large demands on the controls for the actuation of the individual components which are critical for the flight, in order to be able to carry out a predetermined maneuver which is stable in flight. However, during transition from a rapid gliding flight motion into a steep descending path for homing onto an acquired target, there are required particularly sharp or severe course maneuvers, which can easily lead to deflections out of the stable flight pattern; such that the motion of the projectile will no longer listen to the guidance and the target can be missed.

SUMMARY OF THE INVENTION

Accordingly, it is in recognition of these conditions, that the invention has as its primary object to so improve upon guidance or homing methods which are currently employed in the technology, whereby even with the presence of only a pair of horizontal gliding surface on the projectile, it is possible to implement hard or severe yaw maneuvers for rapidly homing onto a target, without any danger that the behavior of the projectile during flight will become unstable, such that the projectile would no longer allow itself to be homed against the target, or in any event, only in an untimely manner.

The foregoing object is achieved through a method of the type under consideration, for homing onto a target detected forwardly, sideways displaced, from the gliding flight path of a projectile which is equipped with a search head, guidance surfaces and horizontal gliding surfaces, through the implementation of a roll motion for the yaw maneuver; in essence, wherein the guidance surfaces are reversed from lift to descent for effecting the transition from the gliding flight path into a yaw maneuver-descent trajectory. In effect, the resultant aerodynamic lifting force is displaced in the sense of minimizing the roll angle in the yaw target direction.

The foregoing is predicated on the recognition that the lateral or sideways homing onto a target from the search-gliding flight path or trajectory is, anyway, connected with a descending movement; such that, as a result, it is not absolutely necessary to also maintain the upwardly directed vector of the lift given during the gliding trajectory during the transverse inclination-yaw control. Instead thereof, through a oppositely directed actuation of the horizontal tail control surface, the onflow of air against the gliding surfaces is so deflected, as to produce an aerodynamic downward pressure on the projectile. The hereby still necessary transverse inclination (roll motion) for the yaw control over the direction of flight towards the target which is to be acquired is small, especially it is much smaller than during the displacement of a maintained lift vector. Hereby, notwithstanding intense yaw maneuvers, only small roll angles are required; and inasmuch as smaller roll angles produce only slight reactions over the flight and control behavior of the projectile, the maneuvering thereof becomes less critical, in effect, the demands on the necessary control and guidance devices of a projectile which is also maneuverable during its final phase of descent, are considerably lower. Additionally, it is advantageous to the invention, that the transition from the gliding trajectory or flight path into the descending trajectory can be effected much more steeply because of the transition from lift to downward pressure. This is particularly of significance at a higher horizontal approach speed towards the target in order not to fly past the position of the target and to thereby miss this target when it is not possible to carry out intense turning maneuvers.

On the other hand, when there is no transition from lift to descending or downward pressure, or is even delayed, in any instance there is initially maintained the lift, when either the target which is to be homed onto, is detected to be already almost closely in front, in effect, under an only small yaw angle, or also even when at a premature changing to downward pressure, the danger is present that the flight path which is to be traversed will no longer be adequate for bridging over a still large distance towards a target.

Even when the target can carry out fleeing movement at the large momentarily present distance, it can be expedient that, notwithstanding the target acquisition, there is initially maintained the lift, in effect, the gliding flight path, until the distance is sufficiently reduced for optimum transition to a steep path of descent. The applicable control or reversing criteria can be obtained, without any difficulty, from the available informations such as distance to the target, and angle of observation line or speed of rotation of observation line, which are already recovered by and evaluated in the search head, or in a control device connected to the output thereof for the collision course-guidance actuation (proportional navigation during the final flight phase) on board the projectile.

BRIEF DESCRIPTION OF THE DRAWINGS

Additional alternatives and modifications, as well as further features and advantages of the invention, can be ascertained from the following detailed description as set forth hereinbelow, taken in conjunction with the accompanying drawings; in which.

DETAILED DESCRIPTION

Figure 1:
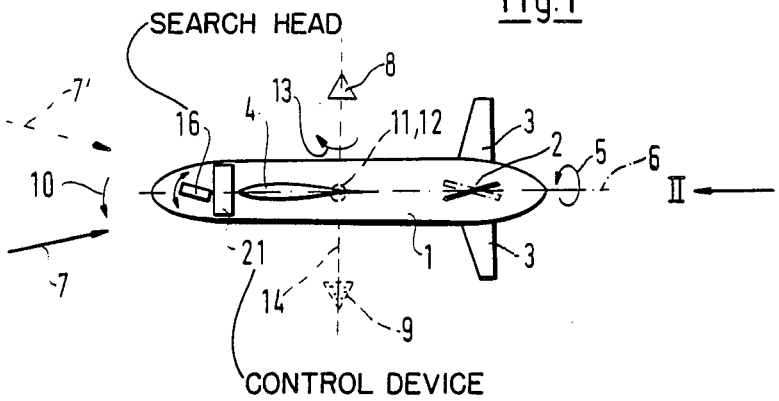
FIG. 1 illustrates a side view of a glideable and guidable projectile with glide surfaces which are restricted to the horizontal plane.
Figure 3:
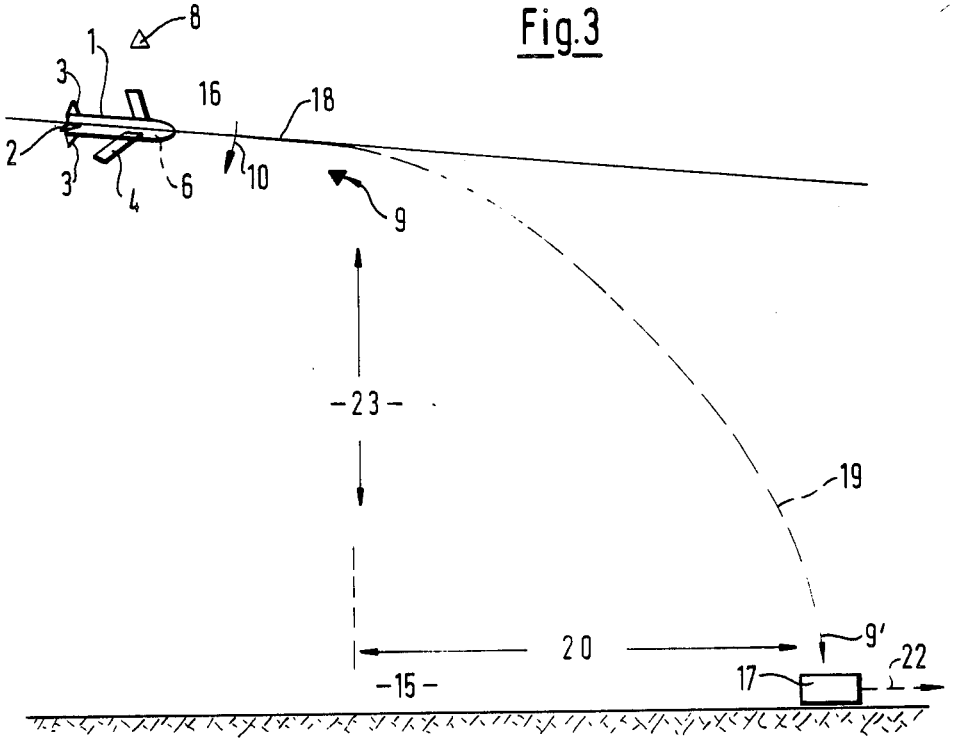
FIG. 3 illustrates a vertical plane through the gliding trajectory of the projectile and the position of the target acquired by the projectile.

The projectile 1, which is illustrated in FIG. 1 in a side view thereof, is equipped with crossed; in essence, paired horizontal and vertically oriented control or guidance surfaces 2, 3, and with a pair of only horizontally extending gliding surfaces 4, which in cross-section are approximately symmetrical. From an opposing positioning, for example, of the horizontal guidance surfaces or fins 2, there results a roll motion 5 about the longitudinal axis 6 of the projectile. Correspondingly positioned components of the horizontal guidance surfaces 2 in the direction which is shown fully extended in FIG. 1, produces an onflow 7 of air against the gliding surfaces 4, which results in a lift 8 of the projectile 1, opposite the gravity which is directed towards the center of the earth; and in which this relates to the normal operating mode for the gliding flight path or trajectory of the projectile 1 oriented generally in parallel with the target area 15. In contrast therewith, a positioning or setting of both horizontal guidance surfaces 2; as shown in phantom lines in FIG. 1, into the angled direction, leads to an onflow 7' of air against the gliding surfaces 4 from which there results a downward pressure or descent 9 of the projectile 1; in effect, an aerodynamic support of the motional components in the direction of the gravitational pull of the earth, and thereby a steep entry from a gliding flight path 18 into a diving descent path 19 (FIG. 3). Through the setting of the horizontal guidance surfaces 2 it is thus possible to implement a pitch motion 10 of the projectile 1 about the cross-axis 1 through its center of gravity 12.

For effecting intense yaw motions 13 about the vertical axis 14 of the center of gravity, the relatively small surface of the vertical control or guidance surfaces 3 and the lateral force resulting the lateral blowing against the narrow rump of the projectile 1 is inadequate, inasmuch as these are not aerodynamically supported by identically oriented air onflow surfaces (in effect, through wing surfaces extending transversely of the horizontal gliding surfaces 4).

For effecting changes in course (yaw motions 13), as is known per se from conventional aircraft guidance, it is consequently necessary that the projectile 1 be rolled into a transverse inclination means of the by horizontal guidance surfaces 2, in effect, carries out a rolling movement 5, until the horizontal gliding surfaces 4 also provide adequate tilting moments in the vertical direction; then the onflow 7 of air, in effect, the now correspondingly laterally inclined vector of the lift 8, leads to a banking flight which is essentially again controlled by the horizontal guidance surfaces 2; until the longitudinal axis 6 has assumed the new direction of flight and, as a result thereof, the rolling movement 5 can again be reversed until reaching of the normal horizontal position.

Figure 2:
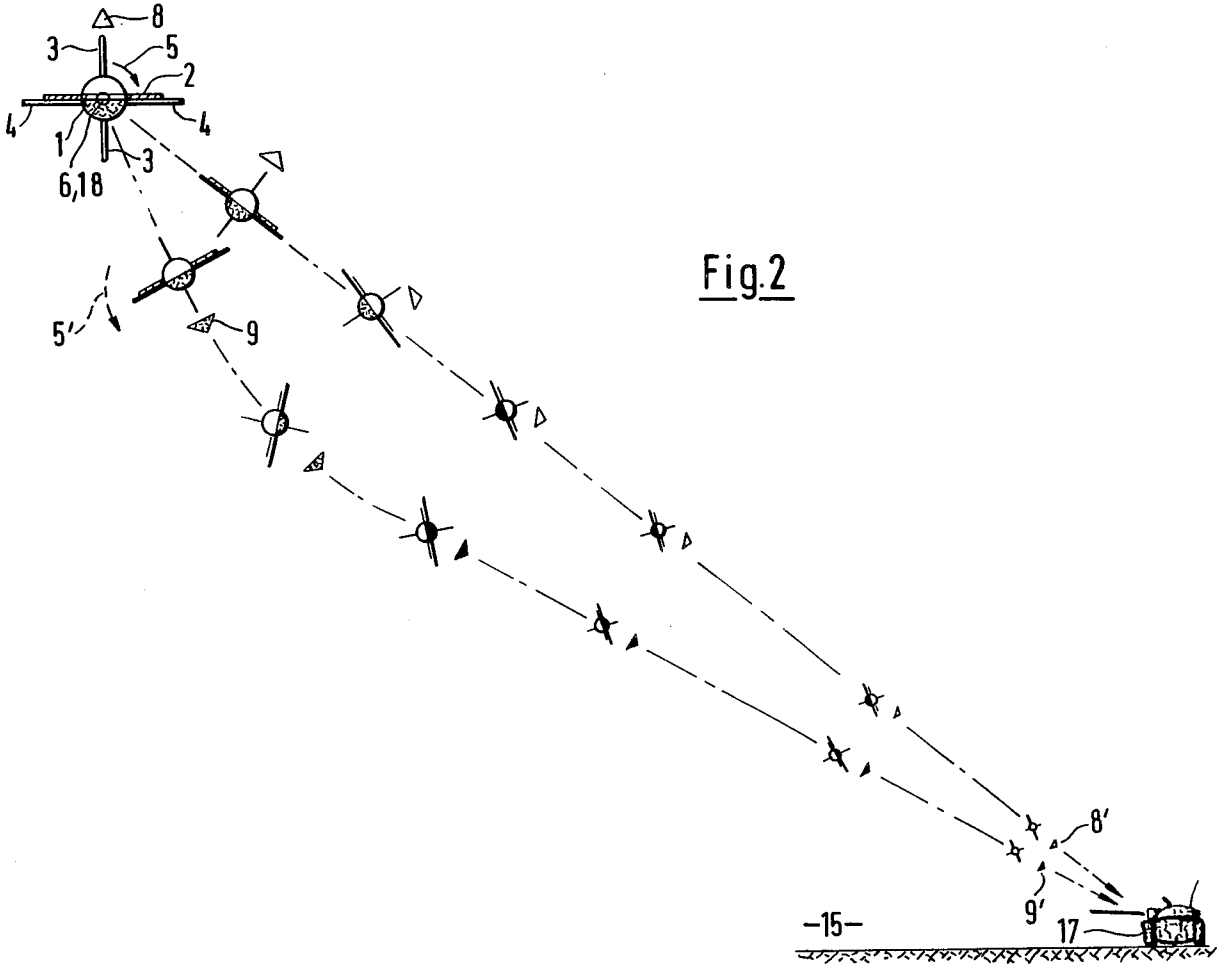
FIG. 2 illustrates a rear view of a projectile according to FIG. 1 during the homing thereof onto a target detected sideways and forwardly thereof, with the representation of the roll procedure for swinging into the lateral deviating direction for the instance of a conventional lift control and for the case of the inventive descent control.

This conventional maneuver of a transverse inclination for the implementation of larger lateral changes in course is represented by the plotted upper sequence in FIG. 2. The timepoint as shown in the upper left of FIG. 2 (which corresponds to the illustration in FIG. 3) seizes the projectile 1, shown for the rear thereof, from its momentary gliding flight path 18 above the target area 15 by means of its pivotable search head 16 (FIG. 1) laterally or sideways ahead of a target 17 which is to be attacked. Whereas, for the homing onto the target 17, the pitch motion 10 in the horizontal plane (pursuant to FIG. 1) is effected through the actuation of the horizontal surfaces 2, preferably in the interest of obtaining the steepest possible approach to the target with a delayed pitch motion 10, which is shown in further detail in British Patent Specification No. 21 34 632; whereas for a conventionable lateral maneuver, the sidewise course correction pursuant to the upper plotted representation in FIG. 2, is a roll motion 5 of almost 180°, in order to primarily during the course of approach to the target to displace the still vertically upwardly directed vector of the rise 8 on the gliding flight path 18, in a direction towards the homed-upon target 17, as illustrated by the arrow for the displaced lift 8' in FIG. 2 at the right rear (on that side of the plane of the illustration of the projectile 1 at the upper left).

When, in contrast therewith, for homing onto the target the horizontal surfaces 2 are switched over to descent 9, as is represented by the lower maneuvering plot in FIG. 2, then for the yaw motion from the momentary gliding flight path 18 there is required an opposite lateral inclination; in effect, an opposed roll motion 5' of the projectile 1. Inasmuch as the pertinent acceleration components for the approach to the target 17, namely the descent 9, now already evidence the applicable orientation, the counter or opposed roll angle 5' which is necessary for the final phase homing, as is indicated from the symbolic representation in FIG. 2, is necessarily considerably smaller than the roll angle 5 during the conventional transverse inclination while maintaining the lift 8. However, the reduced necessary angle of the roll motion 5', as previously mentioned, signifies an improved maneuvering behavior for the projectile 1, and thereby a better controllable and yet a more rapid transition from the gliding flight path or trajectory 18 into the descending trajectory 19; which, in particular, is important when the horizontal distance 20 to the target (transverse of the drawing plane of FIG. 2; referring to FIG. 3) is still only relatively small at detection of the target and switching over into descent 9; in effect, from the high speed in the gliding flight of the projectile there would be required intense yawing maneuvers for effecting a change in the direction of flight towards the target 17.

On the other hand, it is expedient that upon the detection of the target, in every instance there still be initially maintained the setting of the horizontal surfaces 2 for lift 8 (in essence, the control device 21 carried by the search head 16 for the setting of the horizontal surfaces 2, not yet immediately switched over to descending-transverse inclination), when the distance 20 to the target is still quite extensive, or, respectively, because of a fleeing movement 22 of the target 17, does not, or in any case, reduces only relatively slightly. In these instances, for a later, steepest possible (in effect, the most effective from the standpoint of ammunition technology) path of descent 19, there is initially still desirable to provide a continuation of the rapid gliding flight path along the trajectory 18, for reducing the distance 20 to the target.

However, the movement of the flying body or projectile along the gliding flight trajectory 18, necessitates an aerodynamic lift 8 for compensation of the gravitational pull of the earth. The projectile 1 will thus stall from an initial gliding flight trajectory 18, and the target 17 will be reached only in a shallow approach, or even not reached at all, when notwithstanding timely target detection by means of the search head 16, the horizontal distance 18 is still too great for the desired extent of the descending path 19 which is to be assumed during the descent phase.

For the same reason, a switching over to descent 19 is not required, or only first required during the very last phase of the descending path 19; in essence, considerably delayed, when the detected target 17 (pursuant to FIG. 3) is almost located in the vertical plane through momentary gliding flight trajectory 18, whereby, consequently there is required only a slight correction in the yawing course and, correspondingly, only a small roll motion 5 under a maintained vectorial orientation of the lift 8.

What is claimed is:

1. In a method for the homing onto a laterally forwardly detected target from a gliding flight trajectory of a projectile equipped with a search head, guidance surfaces and horizontal gliding surfaces, through the implementation of a roll motion for a yaw maneuver; the improvement comprising switching the guidance surfaces from a lift mode into a descent mode for transition from the gliding trajectory into a descending flight path incorporating said yaw maneuver wherein, at hard yaw maneuvers under large horizontal angles of displacement from the momentary direction of flight of the projectile, there is reduced the roll motion which is to be superimposed on a pitch guidance for the projectile.

2. A method as claimed in claim 1, comprising implementing the switching to said descent mode only when a yaw angle for target approach during descent requires an essentially not larger opposed roll angle for the yawing maneuver than would be required under the maintenance of the lift for the gliding flight trajectory.

3. A method as claimed in claim 1, comprising implementing said switching to descent only when passing below a predetermined horizontal distance to the target.

4. A method as claimed in claim 1, comprising implementing said switching to descent only prior to reaching a predetermined vertical distance to the target.

* * * * *